United States Patent [19]

Guest et al.

[11] Patent Number: 4,544,860

[45] Date of Patent: Oct. 1, 1985

[54] LAMINATED CHANNEL PLATE ELECTRON MULTIPLIER

[75] Inventors: Andrew J. Guest, Crawley; Derek Washington, Wallington, both of England

[73] Assignee: U.S. Philips Corporation, New York, N.Y.

[21] Appl. No.: 434,667

[22] Filed: Oct. 15, 1982

[30] Foreign Application Priority Data

Oct. 19, 1981 [GB] United Kingdom ..... 8131399

[51] Int. Cl.[4] ..... H01J 43/10; H01J 43/28

[52] U.S. Cl. ..... 313/103 CM; 313/105 CM; 313/399

[58] Field of Search ..... 313/399, 103 CM, 105 CM, 313/107

[56] References Cited

U.S. PATENT DOCUMENTS 3,760,214 9/1973 Yamazaki et al. ..... 313/107 X 4,023,063 5/1977 King et al. ..... 313/105 CM X 4,422,005 12/1983 Washington et al. ..... 313/105 CM

*Primary Examiner*—Palmer Demeo

*Assistant Examiner*—Sandra L. O'Shea

*Attorney, Agent, or Firm*—Joseph P. Abate

[57] ABSTRACT

In a laminated channel plate electron multiplier, an apertured metal sheet (32) is disposed at a small distance (30 μm) from the outer surface of the input dynode and is used to provide a small negative field for turning back stray secondary electrons which have sufficient energy to follow trajectories across the input side of the input dynode. More particularly, the areas between the apertures of the input dynode (22) are masked by a material (34) having a secondary electron emission coefficient of less than 2, which material (34) is provided on the outer surface of the apertured metal sheet (32), the metal sheet (32) being spaced from the input dynode (22) by an insulating material (36). A potential of the order of −10 V relative to the input dynode is applied to the apertured metal sheet (32).

18 Claims, 3 Drawing Figures

LAMINATED CHANNEL PLATE ELECTRON MULTIPLIER

BACKGROUND OF THE INVENTION

This invention relates to a laminated plate electron multiplier comprising a stack of conducting sheet dynodes insulated from one another, channels passing transversely through the stack from an input dynode to an output dynode, each channel comprising aligned apertures in the dynodes, the maximum cross-sectional dimension of all the apertures being substantially the same, and at least the walls of the apertures having an exposed secondary electron emissive surface, and means for enabling a repelling field to be provided in the vicinity of the outer surface of the input dynode.

The invention also relates to a cathode ray tube including a laminated plate electron multiplier.

Such channel plate electron multipliers and methods for manufacturing them are described in British Patent Specification No. 1,434,053. In use, the dynodes are held at progressively increasing positive d.c. voltages from input to output. Electrons falling upon the wall of the hole of the input dynode of a channel give rise to an increased number of secondary electrons which pass down the channel to fall upon the wall of the hole of the next more positive dynode where further secondary emission multiplication occurs. This process is repeated down the length of each channel to give a greatly enhanced output electron current substantially proportional to the input current.

Channel plates may be used for intensification of electron images supplied either by the scanning, for example raster scanning, of the electron beam of a cathode ray tube or by a photocathode receiving a radiant image which excites photoelectrons which are fed as a corresponding electron image to the input face of the channel plate. In either event, electrons fall on the portions of the input face of the first dynode of the channel plate between the channels, exciting secondary electrons which, by reason of their spread of emission energy and direction, pursue trajectories in the space in front of the channel plate which can carry them into channels remote from their point of origin. The contrast and definition of the image are degraded by each channel receiving additional input electrons in proportion to their original input electron density at channels over a range of distances away.

The sheet dynodes may be made from a metal alloy such as aluminium magnesium or copper beryllium which is subsequently activated by heating in an oxygen atmosphere to produce a surface all over the dynode which has a high secondary emission coefficient. The input face will thus have an undesirably high secondary emission leading to contrast degradation. Alternatively, the dynodes may be made from sheet steel coated with cryolite, for example, to give a secondary emission coefficient of 4 or 5. In this case also it is impractical to restrict the coating of cryolite to the insides of the holes, and the input face will again have an undesirably high secondary emission coefficient.

British Patent Specification No. 2,090,049A discloses using a mesh-like grid to produce a positive or negative electric field in front of the input face of the input dynode for the purpose of reducing the effect of input electrons striking the secondary emitting surface between the apertures and producing unwanted secondary electrons which spread across the surface of the input dynode and may enter channels remote from their point of origin thus spoiling the contrast and definition of an image to be displayed. Although the electric field produced by the mesh-like grid has been shown to be effective in contributing to the improvement in contrast and definition, there is still a desire to seek a further improvement.

In this connection British Patent Specification No. 2,080,016A discloses improving the contrast of a laminated channel plate electron multiplier by providing a layer of material having a secondary electron emission coefficient less than 2.0 on the outermost surface of the input dynode between the convergent apertures in the input dynode. Conveniently, the material is carbon and is deposited on an apertured carrier sheet placed in contact with said outermost surface. This layer reduces the number of unwanted secondary electrons which are produced but it does not eliminate them. The production of the positive or negative electric fields as disclosed in Patent Specification No. 2,090,049A can be used to advantage with an input dynode having a layer of a material having a secondary emission coefficient less than 2, on the outermost surface between the apertures to reduce the spread of unwanted secondary electrons.

While these techniques go a long way to reducing loss of contrast due to the production of large numbers of secondary electrons from the surface between the apertures at the outermost side of the input dynode, they are less effective in preventing stray secondary electrons from escaping from the inwardly convergent periphery of each aperture in the input dynode and either entering an adjacent channel or not entering a channel at all. The failure of secondary electrons to enter their associated aperture means that the gain of the channel is diminished and that in the case of spatial information it is not displayed accurately.

SUMMARY OF THE INVENTION

In accordance with the present invention, the gain of a laminated channel plate electron multiplier can be improved by the means for enabling a repelling field to be provided comprising an apertured sheet insulated from the outer surface of the input dynode, the apertures in the sheet being arranged in register with those in the input dynode and being at least as large as the openings at the outer surface of the input dynode.

The repelling field provided between the apertured sheet and the input dynode directs secondary electrons produced at the surfaces of the apertures in the input dynode into their associated channels thus preventing them from straying across the input dynode. By directing stray secondary electrons into their associated channels, the gain of the input dynode is improved significantly as well as there being a perceptible improvement in contrast.

If desired, either the area between the openings at the outer surface of the input dynode or the surface of the apertured sheet remote from the input dynode may be masked with a material having a secondary electron emission coefficient of less than 2. An advantage of providing the masking material is that the emission of stray secondary electrons is largely confined to those portions of the walls of the apertures of the input dynode which are least influenced by the field of the secondary dynode. Even so it is estimated that more than 30% of the secondary electrons emitted from the walls of the apertures of the input dynode would become strays unless turned back by a repelling field.

The lower the secondary electron emission coefficient of the material, the greater will be the improvement in contrast obtained. The suppression of secondary emission in electronic devices which would otherwise interfere with the operation of the device is a subject which has been studied by various workers and a survey is given in "Handbook of Materials and Techniques for Vacuum Devices" by Walter H. Kohl, Reinhold Publishing Corp. in Chapter 19 pages 569 to 571. It is known that the secondary emission coefficient of any optically black, microcrystalline layer is much smaller than that of a smooth coherent layer. Carbon in the form of graphite or soot has a low secondary emission coefficient but both may be undesirable in a channel plate multiplier device since it may be difficult to prevent carbon particles entering the channels. If only a few channels at random across the plate are degraded, the appearance of the intensified image in the case of an imaging device may be unacceptable. However, if the carbon is provided as an electron beam evaporated layer on the apertured sheet which serves as a carrier sheet, a high density strongly adherent carbon layer is obtained. Alternatively, the carbon layer may be applied to the apertured sheet by chemical vapor deposition.

The apertured sheet may be insulated from the input dynode by an insulating spacing material such as glass in the case of the sheet being mild steel.

BRIEF DESCRIPTION OF THE DRAWING

The present invention will now be described, by way of example, with reference to the accompanying drawing, in which.

DESCRIPTION OF THE PREFERRED EMBODIMENTS

Figure 1:
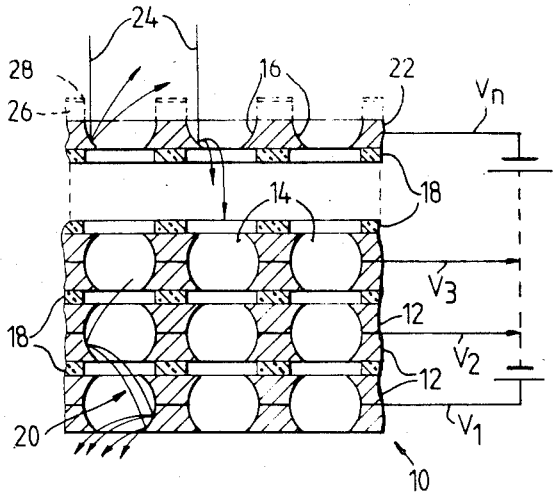
FIG. 1 shows diagrammatically part of a section through the centers of one row of channels of a channel plate electron multiplier.

In FIG. 1, the section through the channel plate electron multiplier 10 shows dynodes made up of pairs of half-dynodes 12. The apertures 14 in the second and subsequent dynodes are barrel-shaped for optimum dynode efficiency as described in British Patent Specification No. 1,434,053. The half-barrel holes in the half-dynodes 12 may be produced by etching, the wall 16 of each tapered half-aperture then being accessible for receiving evaporated layers which may be needed as part of the process of producing a high secondary emission layer in the aperture. The apertures 14 in each row are arranged offset from those in adjoining rows so that they may be regarded as being in a delta arrangement. Pairs of half-dynodes 12 and perforated insulating separators 18 are assembled as a stack. In use potentials $V_1$, $V_2$, $V_3$, . . . $V_n$ are applied to the dynodes, $V_1$ being most positive relative to $V_n$, $V_2$ next most positive and so on. The difference between adjacent potentials is typically 300 volts. By way of illustration schematic trajectories pursued by electrons in the multiplying process are shown at 20.

The first or input dynode 22, to which the potential $V_n$ is applied, is a single half-dynode arranged with the larger of the tapered hole diameters facing the incoming electrons 24. When this half-dynode is coated with secondary emitter, the flat faces are coated as well as the walls of the tapered holes. In principle, the flat face might be masked during coating, but manufacture is eased if the masking operation can be avoided. Consequently, the flat face has the same, intentionally high, secondary emission coefficient as the walls of the holes. Input electrons 24 falling on this face will therefore give rise to substantial numbers of secondary electrons which, by reason of their initial energy and direction, will move out into the space in front of the input dynode 22. The electrostatic field in the space immediately in front of the input dynode 22 will generally be low. For example, in a cathode ray tube having a channel plate electron multiplier in front of a phosphor screen as described in Patent Specification No. 1,434,053, the field will be only weakly directed towards the channel plate input since the acceleration of the electron beam of the cathode ray tube to its final velocity takes place some distance from the channel plate electron multiplier. Hence, secondary electrons emitted from the outer face of the input dynode may be returned to the input dynode 22 but only after pursuing trajectories which carry them laterally across the input dynode 22. Such electrons may then enter channels remote from their point of origin. The contrast and definition of an electron image transmitted by the channel plate electron multiplier are then degraded by each channel receiving additional input electrons in proportion to the original input electron density at channels over a range of distances away.

One way of mitigating this problem is to mask the flat face during operation of the electron multiplier and to reduce the effective secondary emission coefficient as much as possible. British Patent Specification No. 2.080,016A proposes placing a carrier sheet shown in broken lines over the flat outer face of the first dynode 22. The carrier sheet 26 has holes which register with those of the first dynode 22 and which leave the input apertures of the first dynode unobstructed, the solid portion of the carrier sheet 26 masking substantially all of the flat face of the first dynode. The outermost surface of the carrier sheet 26 has a layer 28 of electron beam evaporated carbon. Such a layer 28 is produced by heating a carbon block in a vacuum by electron beam bombardment to a very high temperature in the presence of the carrier sheet alone. The carbon is then evaporated onto the carrier sheet 26 to produce a high density, strongly adherent carbon layer having a secondary electron emission coefficient of 0.8 to 1.3. While this layer does not have as low a coefficient a soot or powdered graphite, it is mechanically far more rugged than either of these two and has a coefficient sufficiently low, less than 2, compared to that of, for example, cryolite which may be used on the walls of the holes and which may have a coefficient between 4 and 5.

In operation, ideally the incident electrons 24 impinge on the convergent walls 16 of the apertures 14 in the input dynode 22 to produce secondary electrons which are drawn into the channels to be incident on the second dynode and so on. However, it has been found that a proportion of the secondary electrons produced on the convergent walls 16, particularly on the part of the multiplying surface which is located farthest from the second dynode, have sufficient energy to follow trajectories which take them away from the input dynode, thus allowing some of them to enter other channels. This means that not only is there a slight loss of contrast but also the gains of the channels are reduced in some places and may be increased in others. This situation is illustrated in the top left hand aperture of the electron multiplier shown in FIG. 1. The proportion of secondary electrons following trajectories not passing through their associated aperture in the input dynode 22 can be more than 30% of those produced from the wall 16 of the aperture.

In order to reduce the effect of this problem and to increase the overall gain of the channel plate electron multiplier, it has been found that by providing a small negative field in front of the input dynode then low energy, secondary electrons emitted from the walls 16 of the apertures and likely to follow trajectories which will take them to other apertures of the input dynode 22 can be turned to pass through their associated aperture.

A simple way of providing such a field is to dispose a grid at a short distance, say 30 μm (micrometers), from the outer surface of the input dynode 22 and applying to it a low negative voltage, typically of the order of −10 V, with respect to the input dynode 22. However, the provision of a simple, mesh-like grid in front of the electron multiplier 10 would leave the flat surfaces between the apertures free to emit secondary electrons which is undesirable as explained previously.

Figure 2:
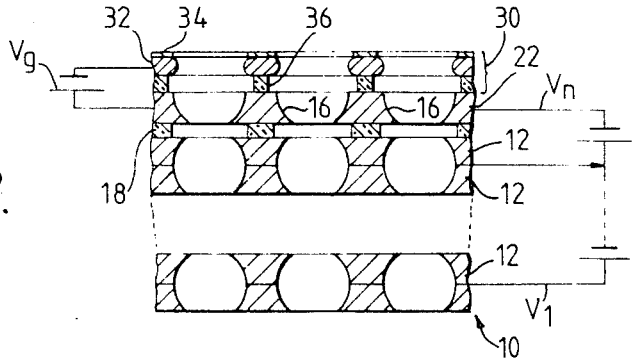
FIG. 2 shows diagrammatically part of a section through the centers of one row of channels of a channel plate electron multiplier made in accordance with the present invention.

FIG. 2 illustrates an arrangement 30 which enables the flat surfaces between the apertures to be masked by a material having a low secondary electron emission coefficient and yet provides the small negative field to turn back any stray secondary electrons emitted from the walls 16 of the apertures in the input dynode.

The manufacture of the dynodes and their assembly into a stack is as that in FIG. 1 and, therefore, will not be described again. The arrangement 30 comprises an apertured carrier sheet 32, the pitch of the apertures in which corresponds to that of the input dynode and the size (i.e. smallest diameter) of the apertures corresponds to the largest diameter of the apertures in the input dynode 22. To one side of the carrier sheet 32 a layer 34 of a masking material, such as vacuum evaporated carbon, having a secondary electron emission coefficient of less than 2 is provided. On the opposite side, an electrically insulating spacing material 36, for example, glass, is provided. The arrangement 30 may be clamped against or bonded to the input dynode 22. In operation, a voltage Vg, typically 10 volts negative with respect to the input dynode 22, is applied between the carrier sheet 32 and the input dynode 22. By means of the additional grid, that is the arrangement 30, it is estimated that the gain of the first dynode 22 is increased by up to 50% and there is in addition a small but perceptible increase in contrast compared with having a masking layer 28 (FIG. 1) on the first dynode.

A method of manufacturing the arrangement 30 is as follows:

In order to ensure that the apertures in the carrier sheet 32 are in accurate register with those of the input dynode 22 all over the input surface of the stack, a half-dynode is used as the starting point for the carrier sheet manufacture. The half-dynodes themselves are typically manufactured from sheet mild steel in which the holes are photochemically etched from a master to ensure that corresponding holes on a stack of dynodes will be in register with one another. In order to enlarge the convergent apertures so that they are of substantially constant cross-section through the thickness of the sheet material, a perforated half-dynode, uncoated with the secondary emitting layer, is mated with a film of self-adhesive plastics materials on the side having the large diameter apertures and is then etched from the opposite side to increase the diameter of the small apertures to substantially equal that of the large apertures and to reduce its thickness. The film is then removed.

The insulating spacing material 36 is applied to one side of the carrier sheet 32. In this example as the carrier sheet is of mild steel then a suitable spacing material is glass which can be applied by techniques such as screen printing, electrophoresis and settling. Thereafter, the glass is fired. In laying down the spacing material 36, it may be applied as dots and/or lines which may for example be straight, serpentine or curvilinear. If the carrier sheet is of aluminium, then the insulation may be obtained by anodization.

The carbon layer 34 is applied to the other surface of the carrier sheet 32 by electron beam evaporation. This is conveniently carried out as described earlier in connection with layer 28 (FIG. 1) and accordingly will not be repeated again in the interest of brevity.

The arrangement 30 may be clamped to the electron multiplier 10 but it is generally preferred to bond the arrangement 30 to the input dynode 22 so as to maintain accurate spacing between them. This can be done in a number of ways, for example, by using a polyimide resin adhesive, a proprietary high vacuum adhesive such as Silvac, or by using a glass having a lower softening temperture than the glass used for the spacing material 36 (such a technique is described in British Patent Specification No. 1,402,549).

As an example of the relative thicknesses of the elements of the arrangement 30, the carrier sheet 32 has a thickness between 80 and 100 μm; the masking layer 34 of carbon has a thickness of 500 Å and the spacing material 36 of settled glass has a thickness of 30 μm.

In an alternative, non-illustrated implementation of the invention, a grid could be spaced from the carbon masking layer 28 in FIG. 1. However, such an arrangement is regarded as being more complicated to fabricate compared with that described with reference to FIG. 2.

Figure 3:
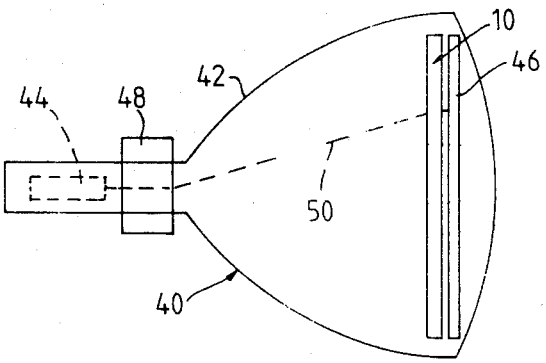
FIG. 3 is a diagrammatic longitudinal view through a cathode ray tube embodying a channel plate electron multiplier made in accordance with the present invention.

Laminated channel plate electron multipliers have a number of applications, in particular in cathode ray tubes used for displaying video information. FIG. 3 illustrates such a tube 40 comprising an envelope 42 in a neck of which is provided an electron gun 44, the laminated channel plate electron multiplier 10 and a display screen 46 disposed adjacent to, but spaced from, the output side of the electron multiplier 10. An electromagnetic deflection yoke 48 is provided on the tube neck to deflect an electron beam 50 across the input face of the electron multiplier 10, for example, in raster fashion. The electron beam 50 has a lower beam energy compared with a conventional display tube and in consequence the deflection fields can be weaker. The electron beam 50 undergoes current multiplication in the electron multiplier 10 and, on leaving the electron multiplier, is post deflection accelerated towards the screen 46.

We claim:

1. A laminated channel plate electron multiplier, comprising:

a stack of electrically-conductive sheet dynodes, the dynodes being insulated and separated from one another by insulating separators, the stack having channels passing through the stack from an outer surface of an input dynode to an output dynode, the input dynode being separated and insulated from the immediately adjacent dynode by an insulating separator having a first substantially uniform thickness, each channel including aligned apertures formed by walls in the dynodes, the apertures having maximum cross-sectional dimensions which are substantially the same;

exposed secondary electron emissive surfaces provided on the walls of the apertures, and means for enabling the provision of an electron repelling field in a vicinity of the outer surface of the input dynode;

characterized in that the enabling means includes an apertured carrier sheet and an electrically-insulating spacing material, the spacing material having a second substantially uniform thickness, the spacing material and the apertured sheet being provided at the vicinity of the outer surface and being arranged such that the apertured sheet is insulated and spaced from the outer surface by the spacing material, the apertured sheet and the spacing material being further arranged such that the apertures in the carrier sheet are in register with the apertures in the input dynode, each aperture in the carrier sheet having a smallest diameter at least as large as the diameter of the respective opening at the outer surface of the input dynode, the second substantially uniform thickness of the spacing material being greater than the first substantially uniform thickness of the insulator separator which insulates the input dynode from the immediately adjacent dynode.

2. An electron multiplier as claimed in claim 1, characterized in that the electrically-insulating spacing material is settled glass and the second substantially uniform thickness is 30 micrometers.

3. An electron multiplier as claimed in claim 1, characterised in that the area between the openings at the outer surface of the input dynode is masked by a material having a secondary electron emission coefficient of less than 2.

4. An electron multiplier as claimed in claim 1, characterised in that a material having a secondary electron emission coefficient of less than 2 is deposited on a surface of the apertured sheet which is remote from the input dynode.

5. An electron multiplier as claimed in claim 3, characterized in that said material is carbon.

6. An electron multiplier as claimed in claim 5, characterized in that the carbon is applied as an electron beam evaporated layer.

7. An electron multiplier as claimed in claim 6, wherein insulating spacing material is provided on the side of said sheet facing the outer surface of the input dynode.

8. An electron multiplier as claimed in claim 7, characterized in that the apertured sheet is made of mild steel and the spacing material is glass.

9. An electron multiplier as claimed in claim 8, characterized in that each dynode other than the input dynode comprises a pair of half-dynodes in contact, the apertures in each half-dynode having a larger cross-sectional opening at the surface on one side of the half-dynode sheet than at the surface on the other side, the larger openings of the pair of half-dynodes facing one another in said pair, and wherein the input dynode comprises a single half-dynode arranged with the larger cross-sectional openings facing outward.

10. A cathode ray tube including an electron multiplier as claimed in claim 9.

11. An electron multiplier as claimed in claim 4, characterized in that said material is carbon.

12. An electron multiplier as claimed in claim 11, characterized in that the carbon is applied as an electron beam evaporated layer.

13. An electron multiplier as claimed in claim 12, wherein insulating spacing material is provided on the side of said sheet facing the outer surface of the input dynode.

14. An electron multiplier as claimed in claim 13, characterized in that the apertured sheet is made of mild steel and the spacing material is glass.

15. An electron multiplier as claimed in claim 14, characterized in that each dynode other than the input dynode comprises a pair of half-dynodes in contact, the apertures in each half-dynode having a larger cross-sectional opening at the surface on one side of the half-dynode sheet than at the other side, the larger openings of the pair of half-dynodes facing one another in said pair, and wherein the input dynode comprises a single half-dynode arranged with the larger cross-sectional openings facing outward.

16. A cathode ray tube including an electron multiplier as claimed in claim 15.

17. A laminated channel plate electron multiplier, comprising:

a stack of electrically-conductive sheet dynodes, the dynodes being insulated and separated from one another by insulating separators, the stack having channels passing through the stack from an outer surface of an input dynode to an output dynode, each channel including aligned apertures formed by walls in the dynodes, the apertures having maximum cross-sectional dimensions which are substantially the same;

exposed secondary electron emissive surfaces provided on the walls of the apertures, and means for enabling the provision of an electron repelling field in a vicinity of the outer surface of the input dynode;

characterized in that the enabling means includes an apertured carrier sheet and an electrically-insulating spacing material, the carrier sheet and the spacing material being provided at the vicinity of the outer surface and being arranged such that the carrier sheet is insulated and spaced from the outer surface by the spacing material, the carrier sheet and the spacing material being further arranged such that the apertures in the carrier sheet are in register with the apertures in the input dynode, each aperture in the carrier sheet having a smallest diameter at least as large as the diameter of the respective opening at the outer surface of the input dynode, and that the multiplier further comprises means for generating a low negative voltage with respect to the input dynode and applying the low negative voltage between the carrier sheet and the input dynode, whereby the gain of the input dynode is substantially increased during normal operation of the electron multiplier.

18. An electron multiplier as claimed in claim 17, characterized in that the carrier sheet and the input dynode have respective substantially uniform thicknesses, the uniform thickness of the carrier sheet being less than the uniform thickness of the input dynode.

* * * * *